United States Patent [19]

Bunnelle

[11] 4,059,166

[45] Nov. 22, 1977

[54] SUBTERRANEAN DRILLING AND SLURRY MINING

[75] Inventor: Philip R. Bunnelle, Santa Clara, Calif.

[73] Assignee: FMC Corporation, San Jose, Calif.

[21] Appl. No.: 704,278

[22] Filed: July 12, 1976

[51] Int. Cl.[2] ..... E21C 37/12

[52] U.S. Cl. ..... 175/232; 166/319; 175/67; 299/17

[58] Field of Search ..... 299/17; 175/67, 87, 175/231, 232; 166/319

[56] References Cited

U.S. PATENT DOCUMENTS

| | | | |
|---|---|---|---|
| 3,155,177 | 11/1964 | Fly | 175/67 |
| 3,316,985 | 5/1967 | Fly | 175/67 |
| 3,730,592 | 5/1973 | Wenneburg | 175/67 |
| 3,747,696 | 7/1973 | Wenneburg | 299/17 X |

*Primary Examiner*—Ernest R. Purser

*Attorney, Agent, or Firm*—F. Ianno; A. J. Moore; C. E. Tripp

[57] ABSTRACT

Subterranean slurry mining with one or more mining nozzles which, during mining, directs a high pressure jet of liquid into a granular ore matrix to reduce the ore to a slurry which is thereafter pumped to the surface by an eductor pump including a high pressure eductor nozzle. The drilling and mining apparatus includes several different types of hydraulic control systems which operates at or below system pressure and allows the apparatus to be changed between the mining and a drilling mode. During drilling, the liquid is directed through an open foot valve and drill bit into the well cavity being drilled to wash the cuttings to the surface at which time the mining and eductor nozzles are closed. During mining the control systems close the foot valve and control the opening of the mining nozzle (or nozzles) and eductor nozzle.

When the control system includes one or more control conduits that extend to the surface, the system may be used to modulate the eductor nozzle, and depending upon the control system being used to selectively open or close the mining nozzle, thereby controlling the pressure or draw-down in the cavity. Self-activating control systems are disclosed and are responsive to differences between system pressure and cavity pressure when the foot valve is closed to modulate the eductor nozzle. Other self-activating control systems may be used to selectively open and close a pair of mining nozzles without modulating the eductor nozzle, or with provision for modulating the eductor nozzle.

42 Claims, 13 Drawing Figures

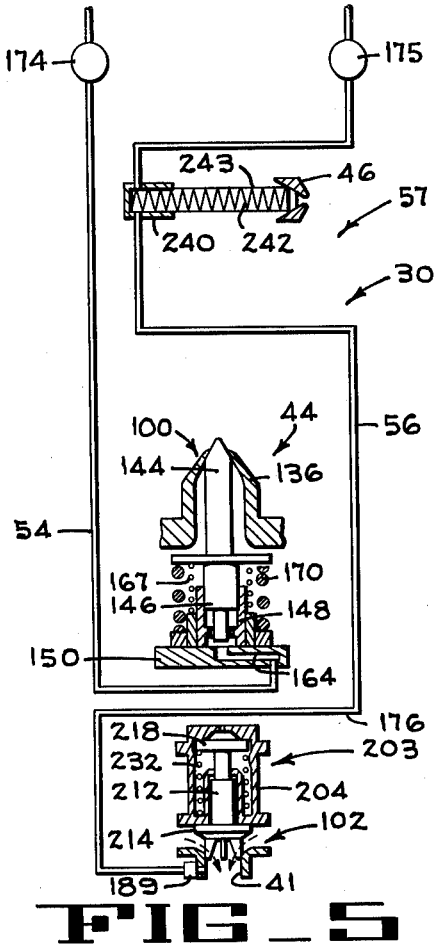
FIG_5
FIG_6
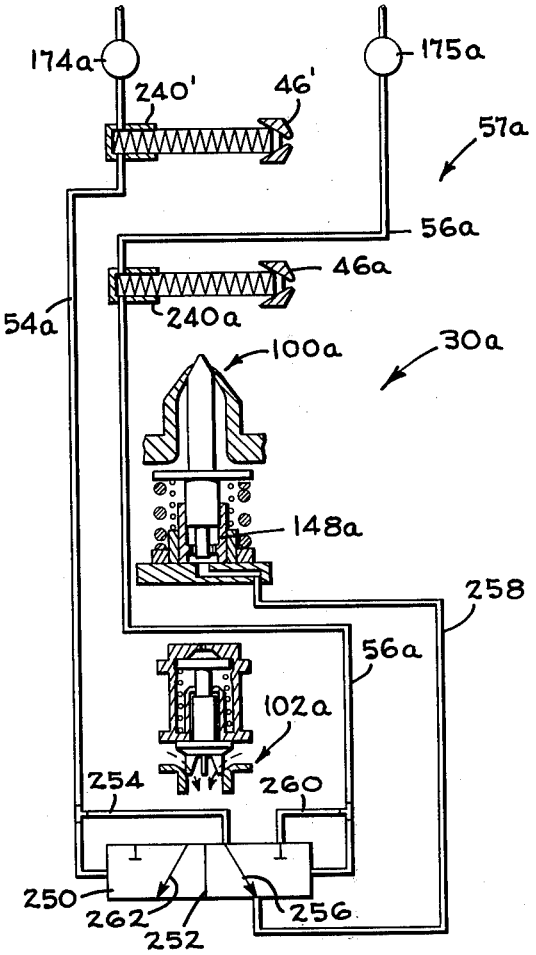
FIG_7
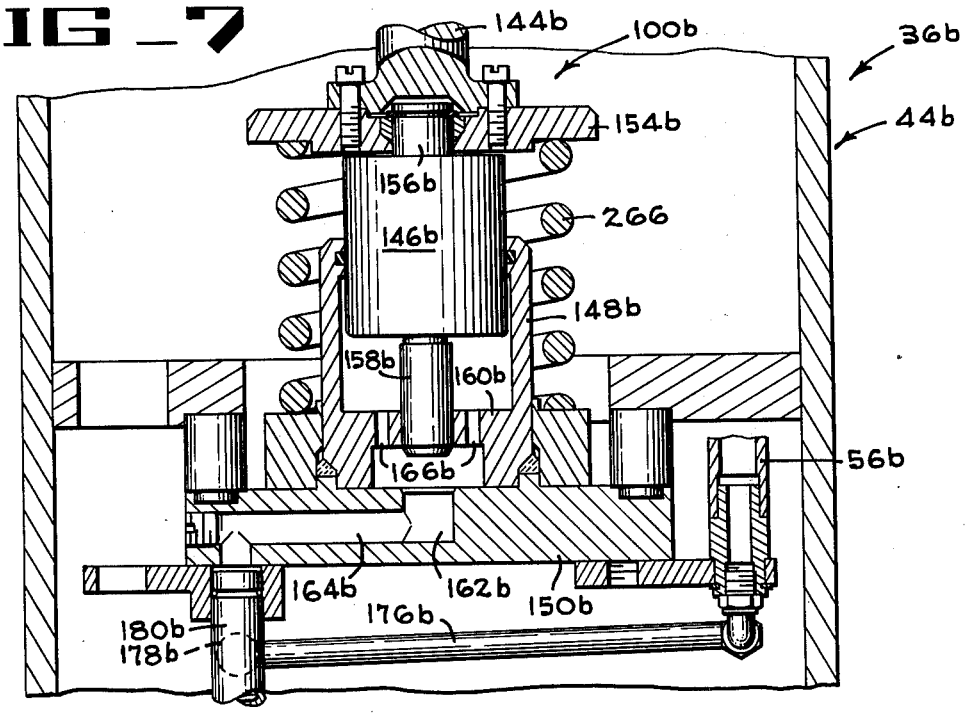

FIG_8
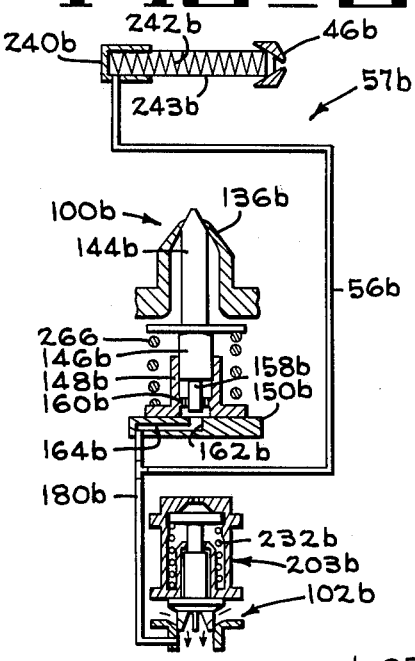
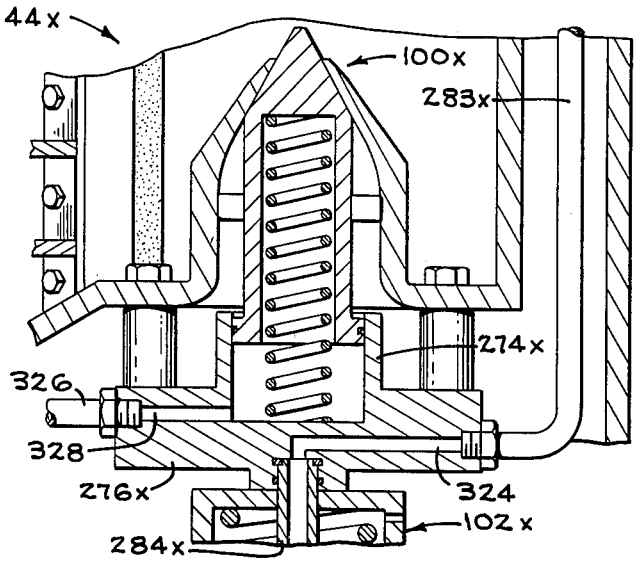
FIG_11
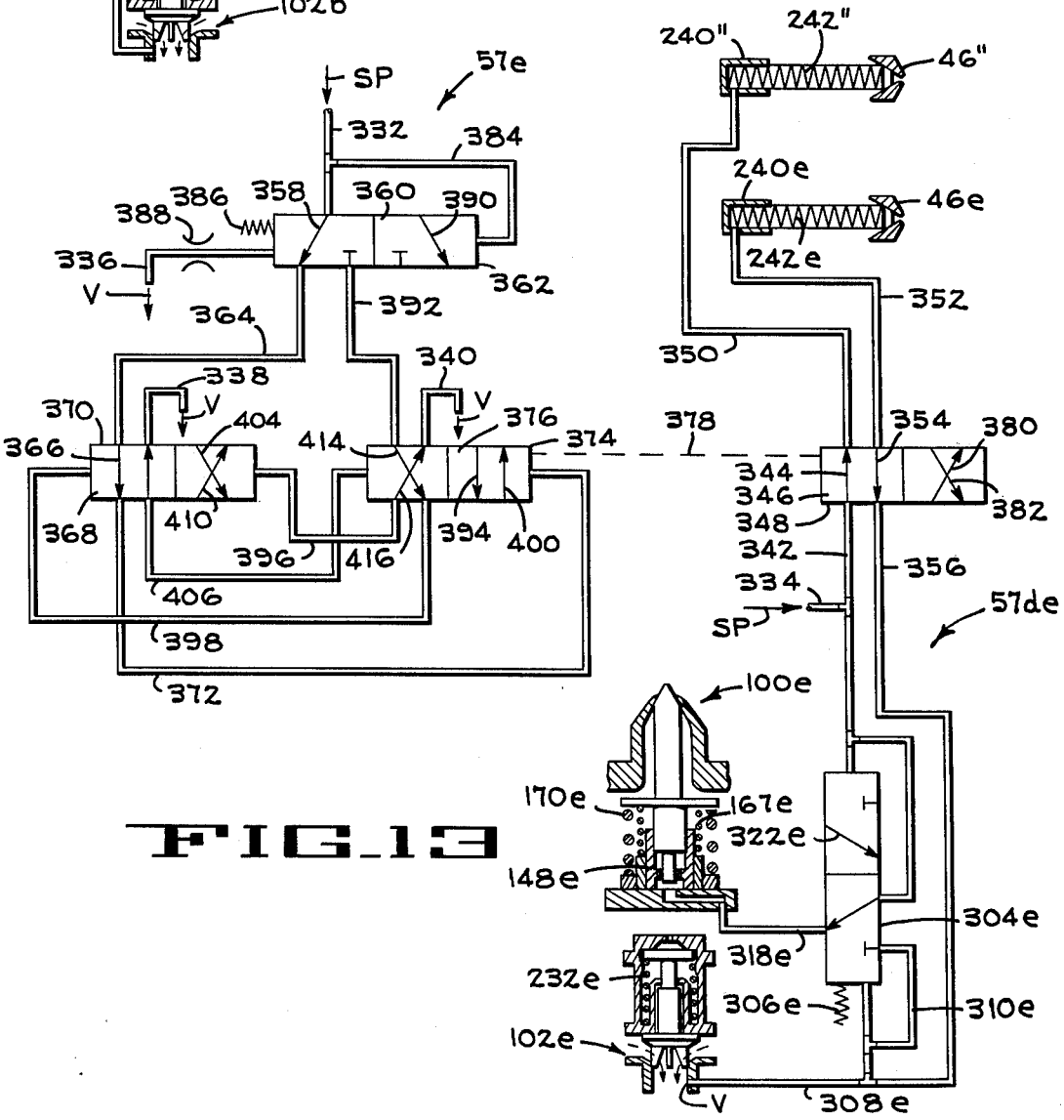
FIG_13

SUBTERRANEAN DRILLING AND SLURRY MINING

CROSS REFERENCE TO RELATED APPLICATIONS

My copending United States Patent Application Ser. No. 704,277 filed on even date herewith and assigned to the assignee of the present invention discloses in detail certain components of the present drilling and mining apparatus not described in detail herein. Accordingly, the subject matter of my copending application is incorporated by reference herein.

BACKGROUND OF THE INVENTION

1. Field of the Invention

This invention pertains to improvements in subterranean slurry mining and more particularly relates to an apparatus for drilling and mining one or more layers of granular ore, such as phosphate ore, without withdrawing the apparatus from the well cavity between the drilling and mining phases.

2. Description of the Prior Art

Subterranean slurry mining of phosphates or the like is broadly known in the art as evidenced by United States Wenneborg et al Pat. Nos. 3,730,592 and 3,747,696 which issued on May 1, 1973 and July 24, 1973, respectively, and are assigned to the assignee of the present invention. The disclosures of both of these patents are incorporated by reference herein.

The modified embodiment of the apparatus disclosed in Wenneborg et al 3,747,696 is pertinent and comprises a combination slurry drilling and mining apparatus which may be changed between its drilling mode of operation and its mining mode of operation to mine several layers of ore without requiring that the apparatus be pulled out of the hole or well cavity. However, the hydraulic control system for changing the several valves from the drilling mode to the mining mode requires a positive pressure of about 2000 psig. in the prior art device which is much greater than the approximately 1000 psig mining pressure. The prior art hydraulic system thus requires additional high pressure pumping equipment, and is also subject to damage due to the very high control pressures and water hammer type forces which may be applied to the system.

Wenneborg et al 3,730,592 discloses a method which contemplates the use of surface controlled pressures equal to or in excess of the drilling pressure for shifting the mining nozzle, the eductor nozzle, and the drill bit foot valve between the drilling mode and the mining mode. In addition, the patentee discloses the use of control pressures which lie in a range between the drilling pressure and a mining pressure for modulating the mining nozzle. Modulation of the mining nozzle is effective to control the cavity pressure, and also the liquid level in the mined cavity to vary the mining conditions for the particular strata being mined.

United States parent and divisional Pat. Nos. 3,155,177 and 3,316,985 which issued to A. B. Fly on Nov. 3, 1964 and May 2, 1967, respectively, disclose a method and apparatus for under-reaming or slurry mining a well, and can also be controlled to alternately bore deeper and mine other strata in the well after the first boring and mining operation have been completed. Valves operated by electric motors located within the tool string convert the apparatus from a drilling operation to a mining operation. The amount of force that can be applied to convert the apparatus from the drilling operation to the mining operation is, accordingly, limited by the size of the electric motors that can fit within the tool string.

SUMMARY OF THE INVENTION

In accordance with the first embodiment of the present invention, the combined drilling and mining apparatus includes a mining nozzle, an eductor nozzle, and a foot valve that operates independently of each other. A first hydraulic control system having one or more control lines to the surface maintains the mining nozzle and eductor nozzle closed during drilling by applying drilling system pressure to the control lines. One of the control lines may also be connected below the foot valves. The foot valve is maintained open during drilling by spring pressure and the lack of sufficient differential pressure drop across the foot valve to effect the closing of the foot valve. During mining, surface controls of the hydraulic control system may be regulated to modulate the eductor nozzle; and independently thereof, to open or close the mining nozzles and sense cavity pressure.

If the drilling and mining apparatus includes two mining nozzles, a second hydraulic control system with the control lines leading to the surfaces is provided. This second control system provides for modulation of the eductor nozzle and also selective opening and closing of each mining nozzle so that only one mining nozzle is open during mining.

A second embodiment of the eductor nozzle is provided and is self-actuated in that it is activated by a third hydraulic control system which merely senses pressure differences between well cavity pressure and the system pressure for opening or closing both the mining nozzle and the eductor nozzle. The third hydraulic control system does not include means for modulating the eductor nozzle.

A third embodiment of an eductor nozzle is associated with an inverted self-cleaning dash pot which also forms the plug of the foot valve to provide a close coupled eductor pump section. A fourth hydraulic control system is self-activating and non-modulating for controlling the opening and closing of the mining nozzle and eductor nozzle of the third embodiment in response to pressure differences between well cavity pressure and system pressure.

A fifth hydraulic control system is self-activating and is provided for use with either the first or fourth embodiment of the eductor nozzle. The fifth control system includes a spring loaded proportioning valve which permits modulation of the eductor nozzle by varying system pressure within a modulating range of about 50 psig from mining system pressure. Although mining system pressures between 700–1000 psig are equally effective in most applications, for simplicity the modulating range will be described as lying between 1000 to 950 psig.

A sixth hydraulic control system is self-activating for use with either the first or fourth embodiments of the eductor nozzle when the drilling and mining apparatus includes two mining nozzles. This control system is activated by variations in the system pressure to modulate the eductor nozzle and senses momentary variations of greater pressure changes to alternately open and close the two mining nozzles. If desired, this sixth control system may be separated into two separate components with one component operating only the mining nozzles and/or the other component operating the eductor nozzle.

A fourth embodiment of the eductor nozzle is quite similar to the third embodiment except that the nozzle is adapted to be modulated under the control of either systems having control lines to the surface or self-activating control systems.

BRIEF DESCRIPTION OF THE DRAWINGS

FIG. 5 is a schematic diagram of a first hydraulic control system having control lines to the surface and being effective to modulate the eductor nozzle and also control the opening and closing of the mining nozzle, one of said lines communicating with cavity below the foot valve to permit sensing cavity pressure.

FIG. 6 is a schematic diagram illustrating a second hydraulic control system that includes control lines to the surface which is effective to modulate the eductor nozzle and also selectively opens and closes each mining nozzle.

FIG. 7 is a central vertical section illustrating a second embodiment of a portion of an eductor nozzle which may be substituted in the apparatus for the equivalent portions of the eductor nozzle of the first embodiment of the invention.

FIG. 8 is a schematic diagram illustrating a third hydraulic control system which is self-activating and non-modulating for use with the eductor nozzle of FIG. 7.

FIG. 11 is a vertical section of a fragment of a fourth embodiment of the eductor nozzle associated with an inverted self-cleaning dash pot and foot valve that is quite similar to FIG. 9 except that it is modified to be connected to an eductor nozzle modulating control system.

FIG. 13 is a schematic diagram illustrating a sixth hydraulic control system that is self-activating and modulating for use with the eductor nozzles of FIGS. 3 and 7 when associated with two mining nozzles.

DESCRIPTION OF THE PREFERRED EMBODIMENT

Figure 1:
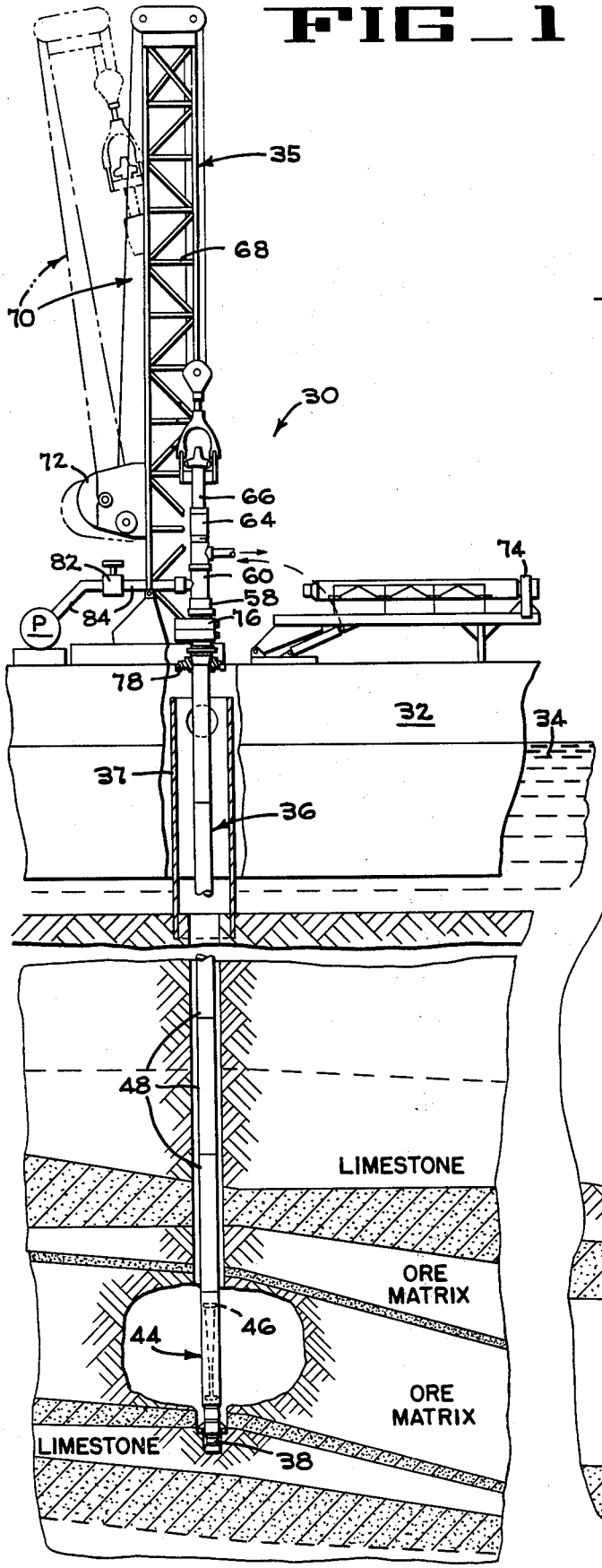
FIG. 1 is a diagrammatic elevation of the drilling and mining apparatus of the present invention shown in its mining mode of operation, certain parts being cut away.

The subterranean drilling and slurry mining apparatus 30 (FIGS. 1 and 2) of the present invention is supported on a mobile vehicle such as a barge 32 floating in a pond 34 over the mining site. Conventional components of a well drilling rig 35 on the barge are employed during the drilling mode of operation to assemble the mining and drilling apparatus 30 section by section. Prior to drilling, the rig 35 is used to drive a large diameter conductor pipe 37 into the floor of the pond 34 to prevent the water in the pond from flowing into the well cavity. The apparatus is then operated in its mining mode to remove and collect a slurry of liquid and ore from the matrix being mined. After the reclaimable granular ore has been mined from one or more ore matrixes at the mining site, the apparatus is pulled from the well and is disassembled enabling the barge to be moved to another site.

Although the apparatus 30 is primarily intended for use in mining phophates from one or more ore strata at depths between about 200 and 300 feet below the surface, it will be understood that the apparatus may be used at other depths, or for mining other types of ore including non-metallic materials. It will be understood that the term "ore" as used herein includes gravel, rocks, or any other solid that the apparatus is capable of slurry pumping to the surface. It will also be understood that the apparatus is capable of handling ore as large as four inches in diameter although the normal consistency of the phosphate ore is somewhat like sand.

In general, the drilling and mining apparatus 30, when fully assembled in its mining mode, includes a tool string 36 that extends downwardly through the conductor pipe 37 and has a conventional rotary bit assembly 38 at its lower end. It will be understood that the bit 38 includes lower cutters 40 and side cutters or underreamers 42 that cooperate to bore a hole or well cavity that is somewhat larger in diameter than the tool string. The bit includes a tubular water passage 41 having orifices 41' at its lower end which restricts the flow therethrough and aids the drilling operation by directing jets of water into the hole being drilled. The side cutters 42 are pivoted inwardly when the tool is being pulled to the surface after the ore has been depleted from the mining site. An eductor pump section 44 is connected to the upper end of the drill bit 38 and a mining nozzle section 45, which includes a mining nozzle 46, is connected to the upper end of the eductor section 44. A plurality of dual string pipe sections 48 (FIG. 1) are connected together and to the mining nozzle section 45 and extend upwardly to the surface. Each pipe section 48 includes an inner string conduit section 50 (FIG. 2) defining a tubular slurry passage, an outer string conduit section 52 which with the inner section 50 defines an outer annular water passage, a control line 54 (FIGS. 4 and 5) and a cavity pressure sensing control line 56 which with the fluid system pressure between the conduits 50, 52 define a hydraulic control system 57 (FIG. 5). The upper end of the uppermost pipe section 48 is connected to a swivel joint 48 (FIG. 2) that forms a portion of a mining head 60. The mining head 60 includes a threaded tool support coupling 62 that receives and is supported by a threaded swivel sub-assembly or drilling head 64.

The drilling head 64 is supported by a hydraulically driven power swivel 66 (FIG. 1) of the well rig 35. The power swivel 66 is guided for vertical movement along the frame 68 of a mast 70 and is raised and lowered by a power driven 100 ton cable hoist 72. The power swivel 66 and the hoist 72 are used to support the tool string 36 during the mining mode of operation and also for raising (or lowering) the tool string a limited amount while mining, if desired, in order to change the vertical location of a jet of water being discharged from the mining nozzle for more effectively breaking up the granular ore matrix being mined.

The drilling head 64 and power swivel 66 are also used as a unit to screw each section of the tool string 36 together and to direct water downwardly through the outer conduit 52 and through the drill bit during the drilling mode. Similarly, the drilling head and power swivel unit is used to unscrew the pipe sections of the tool string 36 from each other when the apparatus is being pulled from the well cavity. During the drilling and pulling operations a well known well loading unit 74, torque wrench 76, and tool slip 78 cooperate with the power swivel 66 in a manner well known in the art to perform the drilling and pulling functions. It will also be noted that the mast 70 is pivotally connected to the barge 32 and may be pivoted away from the well as indicated in dotted lines to permit other standard well drilling operations to be performed when drilling the well cavity. Drilling and mining liquid, hereinafter referred to as water, is directed into the outer conduit 52 at variable pressures and capacities by a pump P, control valve 82 and conduit 84.

All components of the drilling and mining apparatus 30 of the present invention; except for the several embodiments of the eductor pump sections 44, and the control systems 57 for actuating the eductor pump sections and the mining nozzles 46, are substantially the same as the components described in my above identified copending application. Accordingly, only the new components of the eductor pump sections and the control systems therefor will be described in detail. Reference may be had to my copending application for details of the apparatus 30 not specifically described herein.

MODULATING EDUCTOR NOZZLE WITH SURFACE CONTROLS

The first embodiments of the eductor pump section 44 (FIGS. 3–5) is provided with a modulating eductor nozzle 100 that operates independently from a self-actuating foot valve 102.

The eductor pump section 44 includes an inner string conduit section 104 (FIG. 2) of the inner string 50, and an outer string conduit section 106 of the outer string 52, which outer section is provided with diametrically opposed slurry inlet openings 108 (FIGS. 3 and 4) of a slurry inlet section 110 immediately adjacent the eductor nozzle 100.

The lower portion of the outer conduit section 106 includes a centrally apertured lower flange 112, an intermediate flange 114, a nozzle seat flange 116 and a venturi tube flange 118. The flange 118 supports the lower end of a venturi tube 120 (FIGS. 2 and 3) which forms the lower portion of the inner conduit 50. However, mining liquid (hereinafter referred to as water) must flow from above the upper flange 118 to a position below the flanges 114 and 116 without entering the slurry inlet section 110 except through the eductor nozzle 100 as will be described below.

Accordingly, a pair of closed generally arcuate conduit sections 122 (FIG. 4) are rigidly secured between the slurry openings 108 to assure that all drilling and mining water flows downwardly below the flanges 114 and 116 for further distribution. Each arcuate conduit section 122 includes a portion of the outer conduit 106, an arcuate inner conduit portion 124, and edge portions 126 that define opposite sides of the slurry inlet openings 108. Grilles 128 are bolted to the edge portions 126 of adjacent arcuate sections and include spaced horizontal plates 130 and vertical rods 132 spaced about two inches apart to limit the size of the articles which may be drawn into the slurry openings 108. A plurality of holes 134 (only one being shown in FIG. 3) are provided in the intermediate flange 114 thereby allowing the water to flow therepast and through the foot valve 102 when the foot valve is open.

A parabolic nozzle seat 136 having a port 137 therein is rigidly connected and sealed to the apertured flange 116 by capscrews extending through an annular ring 138, an O-ring 140 and cooperating snap ring 142. An eductor valve plug 144 is movable between the illustrated closed position and a position which opens the port 137 varying amounts by a piston 146. The piston 146 is received in a cylinder 148 that is rigidly secured to a base 150, which base is secured to the flange 114 by a plurality of spacers 152. The eductor nozzle plug 144 is bolted to a swivel plate 154 that is connected to the upper end of a piston rod 156 of the piston by a snap ring 157 and a frusto-conical collar 160 that is received in a frusto-conical bore in the swivel plate. The eductor nozzle plug 144 and piston 146 defines a plug-piston unit. Thus, the upper end of the nozzle plug 144 may pivot slightly relative to the axis of the piston to assure proper seating of the plug 144 in the port 137 when the eductor nozzle is closed.

The piston 146 includes the piston rod 156 which has a lower damping portion 158 extending through an aperture in an intermediate wall 160 in the cylinder. The lower damping portion 158 of the piston rod 156 also enters an oversize bore 162 in the base. The bore 162 forms part of a control conduit 164 that is connected to control line 54. Holes 166 are formed in the wall 160 to permit passage of liquid past the wall 160. Entry of the damping portion 158 of the piston rod 156 into the oversize bore 162 further limits the rate of opening of the eductor nozzle 100.

A relatively weak, small diameter compression spring 167 maintains the eductor nozzle 100 closed when no liquid pressure is being applied to the eductor section. The spring 167 is disposed between the swivel plate 154 and a spacer 168 supported by the base 150. A heavier spring 170 is supported by a shim or spacer ring 172 on the base and is spaced from the swivel plate 154 when the eductor nozzle 100 is closed. After the nozzle is partially opened, the heavier spring 170 contacts the plate 154 to cooperate with control liquid entering control end of the cylinder from control line 54 to modulate the nozzle plug 144 thereby regulating the degree of opening of the eductor nozzle 100.

Figure 2:
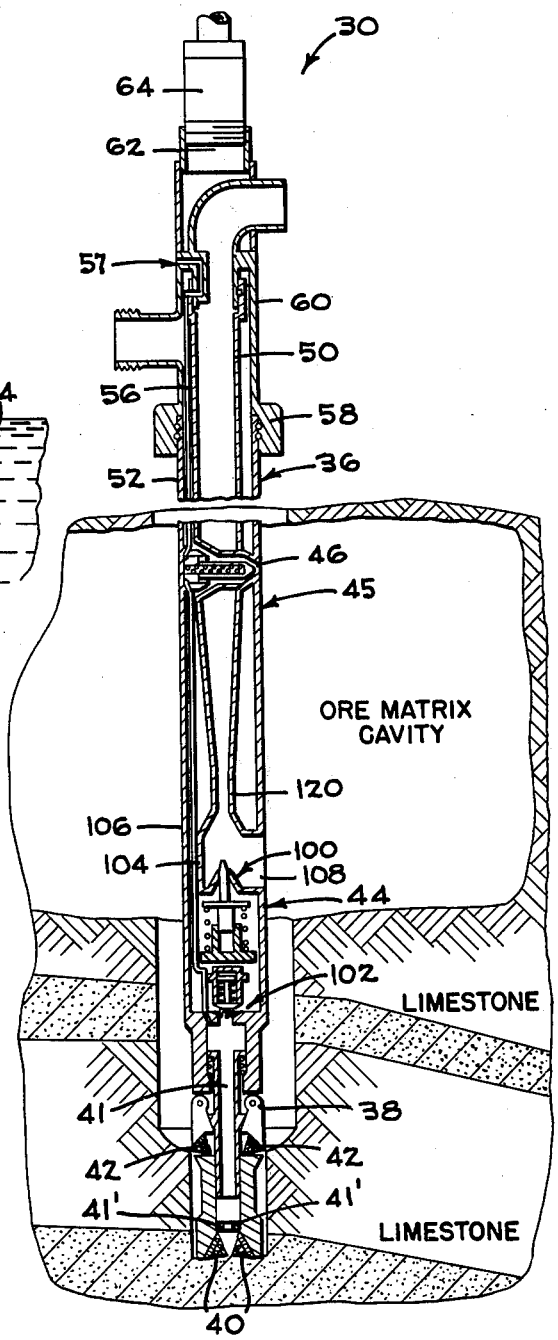
FIG. 2 is a diagrammatic central vertical section taken at a larger scale and illustrating the operative components of the drilling and mining apparatus.
Figures 3, 4:
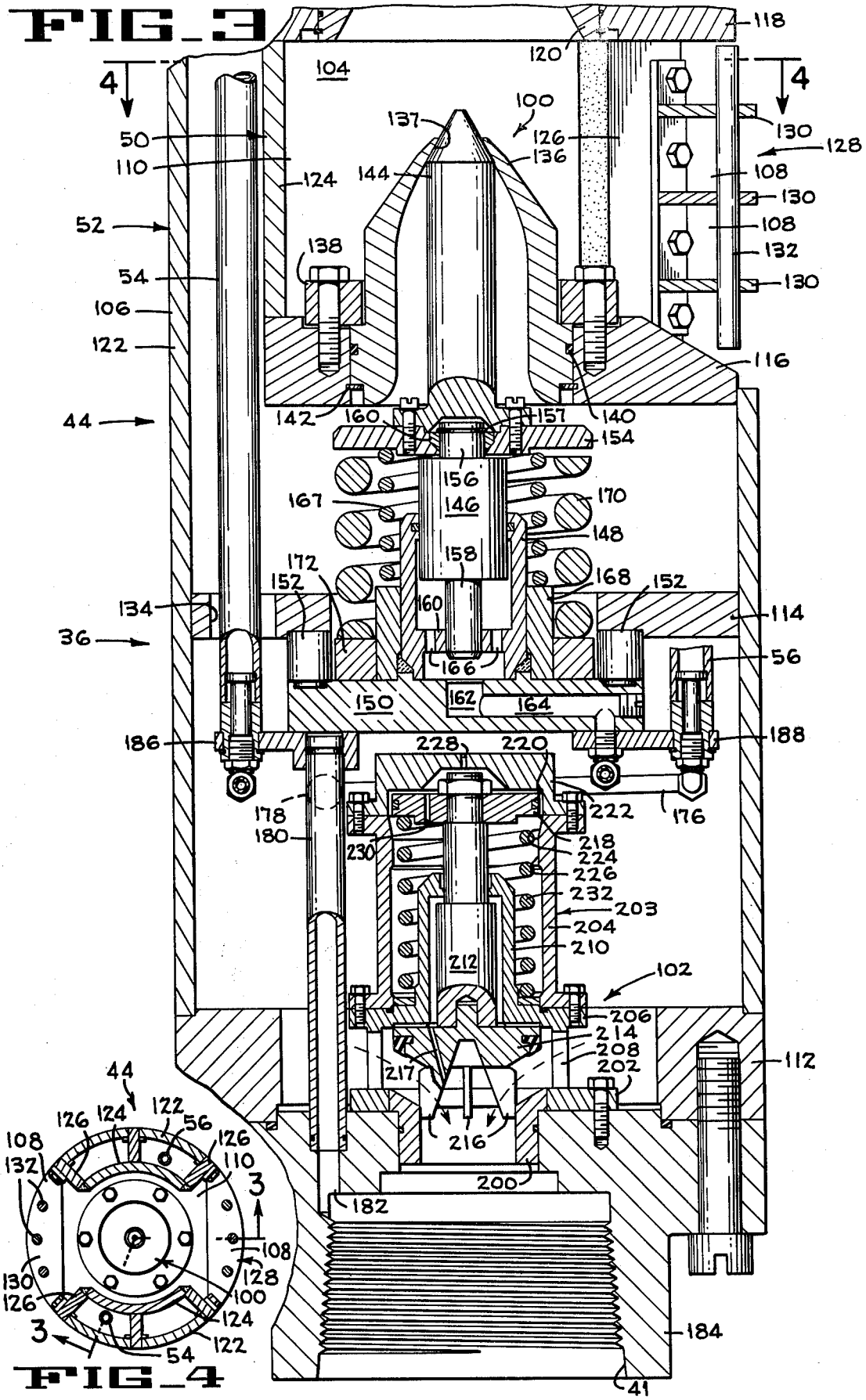
FIG. 3 is an enlarged central section taken along lines 3—3 of FIG. 4 illustrating a first embodiment of the eductor pump section.
FIG. 4 is a horizontal section taken along lines 4—4 of FIG. 3 at a reduced scale.

As indicated in FIGS. 3 and 5, the control conduit or line 54 extends to the surface and is connected to the control end of the cylinder 148 through the conduit 164. A valve 174 on the upper end of the control line 54 may be actuated between positions venting the control line 54 to the atmosphere and directing control pressure into the control line 54 and cylinder 148. The cavity pressure control line 56 includes a valve 175 (FIG. 5) at its upper end and is connected by tubing 176 (FIG. 3), a pipe tee 178, and a short conduit 180 to a passage 182 which communicates with the well cavity through the tubular passage 41 in the drill bit 38 (FIG. 2) in an environment of clean flowing water. The drill bit is screwed into a flange 184 (FIG. 3) bolted to the previously mentioned flange 112. As indicated in FIG. 3, the lower ends of the vertical portions of the control lines 54 and 56 are supported by brackets 186 and 188 that are rigidly secured to the base 150. O-ring seals are provided to isolate the liquid in the control lines 54 and 56 from the surrounding drilling and mining liquid. If desired, flow resisting means 189 (FIG. 5) may be inserted in conduit 176 to provide sufficient resistance in the conduit 56 to allow high pressure water entering the conduit to attain substantially mining system pressure thereby closing the mining nozzle 46.

The foot valve 102 (FIG. 3) is self-activating and is not directly connected to the eductor nozzle plug 144 as was the case in my above mentioned copending application, but operated independently of the eductor nozzle plug 144.

The foot valve 102 comprises a flanged valve seat 200 which is press fitted into the flange 184. A foot valve dash pot 203 includes a damping cylinder 204 which is bolted to a cylinder support base 206 that is rigidly secured to a ring 202 that is bolted to the flange 184 and has a plurality of large flow passages 208 therein. The cylinder support 206 includes an upstanding shaft guide 210 which is apertured to receive an intermediate diameter portion of a shouldered shaft 212 to which a foot valve plug 214 is secured. The foot valve plug 214 includes spaced guide vanes 216 that are slidably received in a port in the valve seat 200 and which permit liquid to flow into the well cavity when in the open position illustrated in FIG. 3. The foot valve plug 214 also includes a small diameter passage 217 which permits a small amount of water to enter the tube 41 in the drill bit assembly 38 during mining when the foot valve is closed.

A damper piston 218 is bolted to the upper end of a shouldered shaft 212 and has its outer peripheral surface disposed within and slightly spaced from a cylindrical bore 220 formed in a cap 222 that is bolted to the upper end of the damping cylinder 204, when the foot valve is open as illustrated. The upper portion of the cylinder 204 is provided with a frusto-conical bore 224 which communicates with the bore 220 and a smaller diameter bore 226 within which the damping piston is seated in fluid tight engagement when the foot valve 102 is closed. Small diameter bleed holes 228 and 230 are formed in the cap 222 and damper piston 218, respectively, for permitting liquid to slowly flow therethrough when the foot valve 102 is being opened or closed. A spring 232 disposed between the piston 218 and the cylinder support 206 holds the foot valve open during drilling and when little or no differential pressure is applied across the foot valve as occurs during the drilling mode.

The modulating control system 57 for the drilling and mining apparatus 30 is provided with a single mining nozzle 46, is illustrated in FIG. 5, and will be described in conjunction with the operation of the apparatus 30. In the discussion to follow, it will be understood that the term "system pressure" refers to the water pressure in the outer annular conduit 52 (FIGS. 2 and 3) which system pressure is about 300 psig during drilling and is about 700 to 1000 psig during mining. The system pressure is taken at the surface and accordingly does not include the pressure head due to the height of water above the eductor nozzle section 75. It will be understood that the pressure in the drill bit water passage 41 is at substantially system pressure when the foot valve 102 is open but is at cavity pressure when the foot valve is closed.

During drilling, water is directed into the outer conduit 52 at about 1400 gallons per minute and at a system pressure at about 300 psig. At this time, the upper ends of the control conduits 54 and 56 (FIG. 5) are also open to system pressure. Thus, the hydraulic pressure acting on opposite sides of the piston 146 of the eductor nozzle 100 is "overbalanced" upwardly since the piston areas subjected to upward and downward system pressure are equal except for the area defined by the tip of the plug 144 which projects through the nozzle port 137 and is subjected to the much lower cavity pressure. This "overbalanced" hydraulic pressure is aided by the spring 167 to hold the eductor nozzle 100 closed. Likewise, the cavity sensing control line 56 directs system pressure within a cylinder 249 of the mining nozzle 46 thus cooperating with a spring 242 to urge the mining nozzle plug-piston unit 243 and the mining nozle 45 into closed position. At this time, system pressure acting in the opposite direction on the external surfaces of the piston 243 is "overbalanced" by system pressure within the cylinder 240 because of area differences acted upon by hydraulic system pressue as indicated above. Cavity pressure control line 56 also directs system pressure into the conduit 41 below the foot valve 102.

Although the flow of 1400 gallons per minute during drilling through the foot valve 102 creates a pressure drop across the foot valve, such pressure drop is not enough to cause the downward force acting on the foot valve to overcome the force of the spring 232. In the preferred embodiment of the invention, the pressure drop across the foot valve during drilling provides a closing force of about 135 pounds, whereas a closing force of about 200 pounds would be required to overcome the spring preload. Most of the 300 psig pressure used in drilling is dissipated across the orifices in the drilling bit. The pressure below the foot valve is nearly the same as system pressure.

After the well cavity has been drilled to the desired mining depth and the apparatus 30 has been assembled in its mining mode, the system pressure is increased to about 450 psig corresponding to a flow rate of about 1700 gallons per minute. This rate of flow across the foot valve increases the pressure drop about 50 percent thus overcoming the resisting force of the spring 232 (FIG. 3) causing the foot valve to commence closing. As the foot valve starts closing, the pressure drop increases with the opposing spring force initially increasing at about the same rate, thus minimizing the chances of the valve being closed due to a momentary hydraulic shock during drilling. Further closing of the valve greatly increases the pressure differential across the foot valve, and thus tends to cause the valve to rapidly close which, if permitted, would result in a severe water hammer shock.

The dash pot 203 is provided to reduce the closing rate of the foot valve 102 to a maximum of about one-half foot per second. During initial closing of the foot valve, water flows through the bleed passage 230 (FIG. 3) in the piston 218 and also between the outer periphery of the piston 218 and the surface of the bore 220 to provide fairly rapid initial closing movement. As the piston 218 moves further down into the frusto-conical surface 224, the flow of liquid around the periphery of the piston gradually decreases, and such peripheral flow terminates (or substantially terminates) when the piston enters the small diameter bore 226. The closing rate of the piston 218 and foot valve plug 214 is maintained substantially constant since the water within the dash pot cylinder 204 must then flow only through the small bleed hole 230 when permitting final closing of the foot valve 102. The pressure below the foot valve decreases as the foot valve closes, being substantially equal to cavity pressure when the valve is closed. During this point in the cycle control vavle 175 (FIG. 5) in the cavity sensing line 56 is closed to prevent discharge of system pressure. When the foot valve is closed, the pressure therebelow is substantially cavity pressure thus opening the mining nozzle 46. After the mining nozzle is open, the valve 175 may be opened to a metered flow of compressed air thus permitting cavity pressure to be measured and recorded at the surface.

With the mining nozzle open and the foot valve 102 closed, a high pressure jet of water is directed into the ore strata at about 700–1000 psig thus reducing the ore to a slurry. At this time the pump capacity is about 6000 to 4000 gallons per minute. As fully discussed in my aforementioned copending application, the tool string 36 is rotated during mining thus enabling the jet of water to form a large generally cylindrical cavity in the ore matrix by reducing the granular ore than had been in the cavity to a slurry of ore and water.

In order to pump the slurry to the surface through the venturi tube 120 (FIG. 2) and the inner pipe string 50, the eductor nozzle is partially or completely opened by actuation of the control valve 174 (FIG. 5) at the surface. When the valve 174 is fully opened to receive full system pressure of, for example, 1000 psig, the hydraulic pressure acting on both ends of the eductor nozzle piston 146 will be at system pressure and will therefore be hydraulically "overbalanced" to the closed position. This force plus the force of the spring 167 will hole the eductor plug 144 closed, causing little if any slurry to be pumped to the surface through the inner pipe string 50. If the valve 174 is fully vented to the atmosphere, the system pressure of 1000 psig will overcome the closing force of springs 167 and 170 thus fully opening the eductor nozzle 100 thereby directing slurry at its maximum rate to the surface through the inner pipe string 50 for collection.

If it is desired to control or vary cavity pressure, or to produce draw down of the liquid level below the mining nozzle, the control valve 174 (which may be automatically controlled) may be adjusted to modulate the eductor nozzle plug 144 thereby controlling the rate at which the slurry is pumped to the surface.

In an apparatus 30 designed to operate with a drilling system pressure of about 300 psig and a mining system pressure of about 1000 psig, the modulating control pressure preferably lies within a modulating range of between about 150 to 500 psig. It is, of course, understood that this pressure range is given by way of example and that the pressure required when mining at substantially different levels or with different size equipment may vary considerably.

As mentioned previously, the relatively weak spring 167 (FIGS. 3 and 5) permits the eductor plug to open a small amount before the heavy spring 170 is contacted by the swivel plate 154. The thickness of the spacer ring 172 may be selected as desired and such selection determines the percentage of full open that the nozzle plug will reach prior to engaging the heavy spring. For example, an initial nozzle opening of 60 percent, which is achieved by reducing the pressure in the control line 54 to slightly above 500 psig, provides a modulating range of 40 percent. Thus, by varying the control pressure between about 500 to 150 psig in line 54 by selective actuation of the valve 174, the eductor nozzle opening is varied between its 60 percent open and full open positions.

SURFACE CONTROLLED DUAL MINING NOZZLE CONTROL SYSTEM WITH MODULATING EDUCTOR NOZZLE

FIG. 6 illustrates an eductor nozzle modulating control system **57*a* for a drilling and mining apparatus 30*a* which is substantially the same as the above described apparatus 30 except that two mining nozzles 46' and 46*a* are provided instead of a single mining nozzle. As indicated in greater detail in my aforementioned copending application, two or more layers of granular ore are sometimes present in the area being mined. Thus, it becomes advantageous if both layers can be mined without requiring that the apparatus be changed from its mining mode to its drilling mode and back to its mining mode in order to mine the two layers of ore. This can be accomplished by the alternate use of two (or more) mining nozzles 46' and 46*a* positioned at the desired height to mine associated ore layers or matrixes. It will be understood that the ore which is reduced to a slurry by each mining nozzle 46', 46*a* will gravitate downwardly and will be pumped to the surface by the same eductor nozzle 100*a*** and the components associated therewith.

Since the apparatus **30*a* and the control system 57*a* are substantially the same as those previously described, only the differences will be described in detail. Parts of the control system 57*a* which are equivalent to the control system 57** will be assigned the same numerals followed by the letter "*a*".

As indicated in FIG. 6, control line **54*a* with control valve 174*a* therein is connected to the cylinder 240' of the mining nozzle 46' and to one end of a shuttle valve 250 having a core 252 therein that is shifted by pressure differences acting on its opposite ends. Similarly, the control line 56*a* with control valve 175*a* therein is connected to the cylinder 240*a* of mining nozzle 46*a* and to the other end of the shuttle valve 250. A branch conduit 254 is connected between the control conduit 54*a* and a cross passage 256 in the valve 250 which communicates with the cylinder 148*a* of the eductor nozzle 100*a* through a conduit 258 when the core 252 is shifted to the left as indicated in FIG. 6. In order to shift the core 252 to the illustrated position, the control valve 175*a* is open to system pressure (for example about 1000 psig) thus maintaining the mining nozzle 46*a* closed. The control valve 174*a* is completely vented or is partially vented to provide a control pressure that is less than system pressure thus opening mining nozzle 46'. At this time, a branch conduit 260 connected between the control conduit 56*a* and the shuttle valve 250 is closed by the core 252**.

With the shuttle valve 250 positioned as above described, the control valve **174*a* may be manually or automatically controlled to vary the pressure between about 500 t 150 psig in to line 54*a*, conduit 258, and eductor nozzle cylinder 148*a*. This varying control pressure in the eductor nozzle cylinder 148*a* will cause the eductor nozzle to modulate as previously described. Also, control pressure within the modulating range of 150–500 psig will not be sufficient to close the mining nozzle 46' as described in more detail in my cross referenced copending application. Complete venting or 0 psig in the cylinder 148*a* will obviously fully open the eductor nozzle. The self-actuating foot valve 102*a*** remains closed during mining and is controlled in a manner identical to that previously described.

When it is desired to mine the other ore strata by opening mining nozzle 46a and closing mining nozzle 46', valve 175a is vented or partially vented and valve 174a is open to the 1000 psig mining system pressure thus closing nozzle 46' and shifting the shuttle valve core 252 to the right (FIG. 6). At this time branch conduit 254 will be closed by the core 252, and branch conduit 260 will be open to the eductor nozzle cylinder 148a through a passage 262 in the shuttle valve and the conduit 258. The valve 175a may then be adjusted to vary the control pressure to the cylinder 148a of the eductor nozzle 100a between about 500 and 150 psig thus modulating the eductor nozzle as previously described.

SELF ACTUATING EDUCTOR NOZZLE

A second embodiment of the eductor pump section 44b providing a self-actuating form of eductor nozzle 100b is illustrated in FIGS. 7 and 8 and requires no control conduits to the surface in order to open and close the nozzle plug 144b relative to its seat 136b (FIG. 8). The eductor nozzle 100b is shifted between its drilling mode (at which time it is closed) and its mining mode (at which time it is fully opened) in response to detecting differences between the system pressure and the well cavity pressure. It will be understood that this eductor nozzle will be used when modulation of the eductor nozzle is not required for the particular type of granular ore being mined.

Since all components of the apparatus except the control system 57b and the eductor nozzle 100 b are the same as previously described in regard to the first embodiment of the invention, only the differences between the two embodiments will be described in detail. Parts of the eductor nozle 100b which are similar to those of the first embodiment will be assigned the same numerals followed by the letter "*b*".

The eductor nozzle plug 144b is bolted to a swivel plate 154b (FIG. 7) and is connected to the upper end of the piston rod 156b of a piston 146b that is larger than the previously described piston 146 (FIG. 3) in order to provide quicker opening of the eductor nozzle. The piston 146b is received in a cylinder 148b having a flow restricting baffle 160b near its lower end. The baffle is provided with holes 166b and is drilled to receive the lower damping portion 158b of the piston rod 156b.

As the piston moves downwardly to its full open position, the lower end 158b of the piston rod enters the counter bore 162b in the base 150b which restricts fluid flow and limits the rate of movement of the piston 146b and eductor plug 144b. The passage 164b in the base 150b and a larger diameter conduit 180b establishes a flow passage between the cavity below the foot valve 102b (FIG. 8) and the eductor nozzle cylinder 148b. A pipe tee 178b in the conduit 180b, a section of tubing 176b, and the cavity pressure control line 56b establishes communication between the cavity below the foot valve and the cylinder 240b of the mining nozzle 46b. The mining nozzle plug 243b is urged towards its closed position by a spring 242b and is opened when the force developed by system pressure on the output side of the plug 243b is greater than the sum of spring force and the force developed by the control pressure within conduit 56b and cylinder 240b acting on the other side of the plug 243b.

The eductor nozzle 100b differs from the nozzle 100 of the first embodiment of the invention in that a single spring 266, rather than two springs, is disposed between the swivel plate 154b and the base 150b.

During drilling, the pressure below the foot valve and in the control lines is nearly the same as system pressure. Since it acts on a much larger area than system pressure it serves to keep eductor and mining nozzles closed during drilling in conjunction with spring forces.

In operation of an apparatus which includes the self-actuating eductor nozzle 100b, the mining nozzle 46b, and the foot valve 102b; it will be understood that prior to introducing water into the tool string 36b (FIG. 7) that the spring 242b holds the mining nozzle closed, spring 266 holds the eductor nozzle 100b closed, and the spring 232b holds the foot valve 102b open. During drilling, the system pressure is about 300 psig and the water flow across the foot valve is about 1400 gallons per minute which is insufficient to create a sufficient pressure drop across the foot valve to close the foot valve by overcoming the pressure of spring 232b. Thus, during drilling the pressure below the foot valve is close to system pressure and is directed into both cylinders 148b and 240b. This pressure acts on the full piston area of nozzle plugs 243b and 146b, while system pressure acts on the piston area less the nozzle area, which is exposed to a much lower cavity pressure.

During mining, the foot valve 102b operates as previously described in regard to the first embodiment of the invention. In this regard the system pressure of, for example, about 450 psig and flow rate of about 1700 gallons per minute across the foot valve creates a sufficient pressure drop to close the foot valve 102b in a controlled fashion through the action of the dash pot 203b. Since the foot valve closes comparatively slowly, the relatively large area of the piston 146b that is exposed to the 450 psig system pressure on one side, and the gradually decreasing pressure on the other side, causes the eductor nozzle plug 144b to at least substantially open prior to the foot valve closing against the urging of the spring 232b. The creation of a low pressure below the foot valve and the transmission of low cavity pressure to the cylinder 240b of the mining nozzle 46b thus permits system pressure to fully open the mining nozzle 46b against the urging of spring 242b.

FOOT VALVE WITH SELF-CLEANING DASH POT AND SELF-ACTIVATING NON-MODULATING CONTROL SYSTEM

Figure 9:
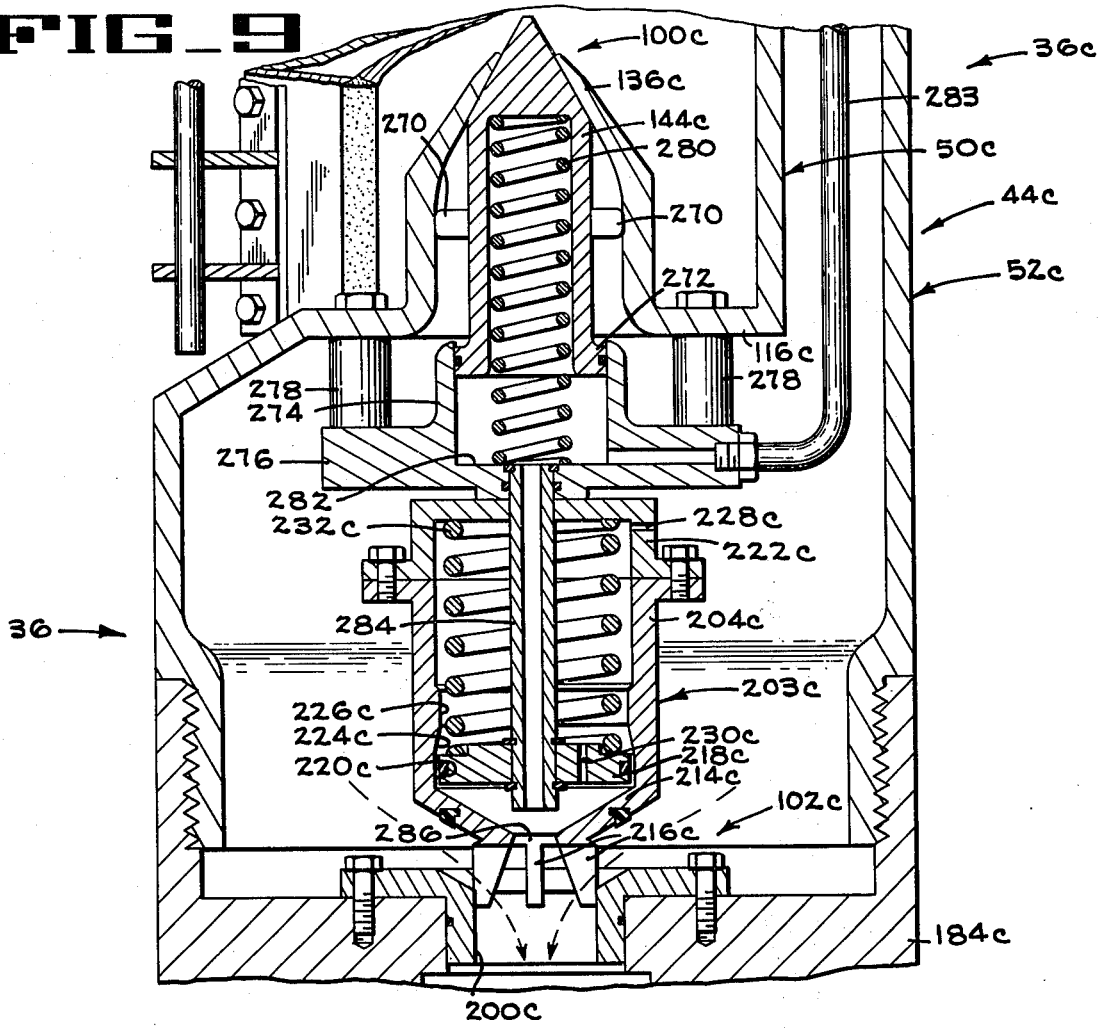
FIG. 9 is a vertical section of a third embodiment of an eductor nozzle associated with an inverted self-cleaning dash pot that also forms a portion of the foot valve.
Figure 10:
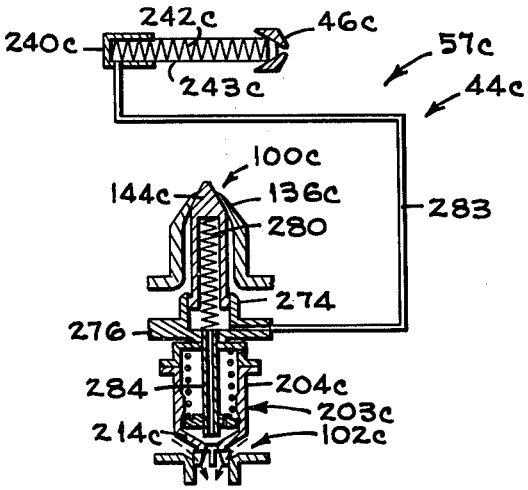
FIG. 10 is a schematic diagram illustrating a fourth hydraulic control system that is self-activating and non-modulating for use with the eductor nozzle of FIG. 9.

A third embodiment of the eductor pump section 44c and conrol system 57c is illustrated in FIGS. 9 and 10. This section is similar to the first embodiment of the invention and differs primarily in that cylinder 204c of the dash pot 203c is inverted and is an integral portion of the plug 214c of the foot valve 102c. Thus, only the differences between the two embodiments will be described in detail, and parts of the third embodiment that are similar to the first embodiment will be assigned the same numerals followed by the letter "*c*".

The valve seat 136c of the eductor nozzle 100c receives an eductor nozzle plug 144c that has guide fins 270 on its outer periphery and has a piston 272 formed on its lower end. The piston 272 is slidably received in a cylinder 274 having a flanged base 276 that is rigidly secured to the flange 116c by capscrews and spacers 278. A compression spring 280 is disposed between the lower wall 282 of the cylinder 274 and the upper wall of a cavity in the eductor nozzle plug 144c, and urges the eductor nozzle plug 144c toward its closed position.

A control conduit 283 is connected between the cylinder 240C (FIG. 10) of the mining nozzle 46c and the eductor nozzle cylinder 274. The base 276 of the eductor nozzle 100c is apertured to receive a tube 284 rigid therewith and projecting downwardly therefrom. The lower end of the tube 284 is opened to pressure below the foot valve and accordingly directs this pressure into both the eductor nozzle cylinder 274 and the mining nozzle cylinder 240c when the foot valve 102c is closed. The damper piston 218c is secured to the tube 284 by snap rings or the like and is provided with a bleed passage 230c.

As mentioned above, the dash pot cylinder 204c is inverted relative to the dash pot of the first embodiment of the invention. The cylinder 204c has a cap 222c with a bleed hole 228c therein bolted to the cylinder and is centrally apertured to slidably receive the tube 284. The spring 232c is disposed between the cap 222c and the piston 218c and normally urges the foot valve 102c to its open position. The lower end of the cylinder defines the foot valve plug 214c which is provided with a large diameter central port 286 that establishes free communication between the cavity below the foot and the interior of the cylinder 204c below the piston 218c. The foot valve plug 214c includes guide vanes 216c which are received in the port of the valve seat 200c that is secured to the flange 184c to which the tubular drill bit 38 (FIG. 2) is secured. Thus, when the foot valve 102c is open as illustrated in FIG. 9, water is directed between the guide vanes 216c, through the foot valve seat 200c and through the tubular drill bit 38 into the well cavity being drilled. When the foot valve moves downwardly into the closed position, the major flow of water is prevented from entering the cavity and is split to flow through the eductor nozzle 100c and the mining nozzle 46c (FIG. 10) both of which are open at this time.

As illustrated in FIG. 9, as the foot valve moves downwardly the outer periphery of the damper piston 218c is progressively moved within the large diameter cylindrical bore 220c, the frusto-conical bore 224c, and the small diameter bore 226c thereby progressively increasing the resistance to the flow of water across the piston and progressively reduces the rate of closing movement of the foot valve.

Since the tube 284 is positioned coaxially within the inner conduit 50c and the outer conduit 52c of the tool string 36c, the spacing between the eductor nozzle 100c and the foot valve 102c is much less than in the previously described embodiments of the invention. Also, the flange 184c is connected by screw threads rather than by bolts to the outer pipe section 52c, which threaded connection is a much faster and less expensive manner of connecting the components together.

In operation of the eductor pump section 44c and the mining nozzle 46c of the third embodiment of the invention, reference is directed to FIGS. 9 and 10. During drilling, about 1400 gallons per minute of water at a system pressure of about 300 psig is directed between the inner and outer pipe sections 50c, 52c and through the foot valve 102c into the well cavity. As this time the pressure drop across the foot valve 102c is insufficient to reduce the pressure below the foot valve enough to overcome the resilience of the dash pot spring 232c, the eductor nozzle spring 280, or the mining nozzle spring 242c. Thus, during drilling the foot valve remains open and the eductor nozzle and mining nozzle are both held closed by spring force and fluid pressure.

At the start of mining, the capacity of water is increased to about 1700 gallons per minute and the pressure is increased to a system pressure of about 450 psig. The increased flow of water through the foot valve 102c increases the pressure drop across the foot valve enough to cause the foot valve to move downwardly against the urging of the spring 232c. As the foot valve closes, the pressure below the foot valve is reduced enough, compared to the 450 psig system pressure, to allow system pressure to overcome the force of the springs 280 and 242c thus opening the eductor nozzle 100c and the mining nozzle 46c. The rate at which the foot valve 102c is allowed to close is controlled gy the dash pot 203c. Since the water within the dash pot must flow between the piston 218 (FIG. 9) and the internal surface of the cylinder 204c in order for the foot valve to close, the gradual decrease in flow passage size, as determined by the surfaces 220c, 224c and 226c, as the cylinder moves downwardly results in a controlled closing of the foot valve in the face of increasing pressure drop across the valves. During final closing of the foot valve, the water within the cylinder above the piston 218c must flow through bleed holes 230c and 228c.

As the foot valve 102c closes, the eductor nozzle 100c and mining nozzle 46c begin to close. Since the cylinders 274 and 240c are both filled with water which must be displaced before the nozzle plugs 144c and 243c can open, it is apparent that the relatively small passages in the tube 284 and conduit 283 will restrict rate of flow of liquid therethrough. Thus, the size of these passages may be selected so as to control the rate of opening of the eductor nozzle 100c and mining nozzle 46c to thereby reduce water hammer to an acceptable degree.

It will be appreciated that during mining when the foot valve 102c is closed, a small amount of water will flow through bleed passages 228c and 230c into the well cavity therebelow thus tending to maintain the dash pot 203c free from sand and dirt or the like. Likewise, when the foot valve is open, any contaminates that enter the dash pot will be flushed therefrom into the well cavity through the relatively large annular opening defined between the outer periphery of the piston 218c and the port 220c. This water and debris then flows through opening 286 into the well cavity.

FOOT VALVE WITH SELF-CLEANING DASH POT AND MODULATING CONTROL SYSTEM

A fragment of a fourth embodiment of the eductor pump section 44x is illustrated in FIG. 11, and is identical to the third embodiment except that the eductor nozzle 100x is designed so that it may be modulated. Thus, only the differences will be described in detail, and components of the eductor pump secion 44x that are equivalent to the eductor pump section 44c will be assigned the same numerals followed by the letter *x*.

The eductor nozzle 100x includes a flanged base 276x that is thicker than the base 276 (FIG. 9) and has a passage 324 therein that establishes communication between control conduit 283x leading to the associated mining nozzle and the tube 284x of the foot valve 102x which communicates with cavity pressure when the foot valve is closed. It is particularly noted that the eductor nozzle cylinder 274x does not communicate through the tube 284x to cavity pressure, but instead is connected to a control line 326 by a port 328.

If surface conrol is desirable, the eductor pump section 44x is substituted for the pump section 44 (FIG. 5) or 44b (FIG. 6) and is controlled by control systems similar to those described in connection with FIGS. 5 and 6. The resulting operation of the pump section 44x is substantially the same as described in those systems. In this regard, conduits 326 and 283x are connected to conduits 54 and 56, respectively, if a control system similar to the system illustrated in FIG. 5 is used; and are connected to control lines 54a and 56a respectively if the FIG. 6 system is to be used.

CONTROL SYSTEM FOR MODULATING EDUCTOR NOZZLE WITHOUT CONTROLS TO THE SURFACE

Figure 12:
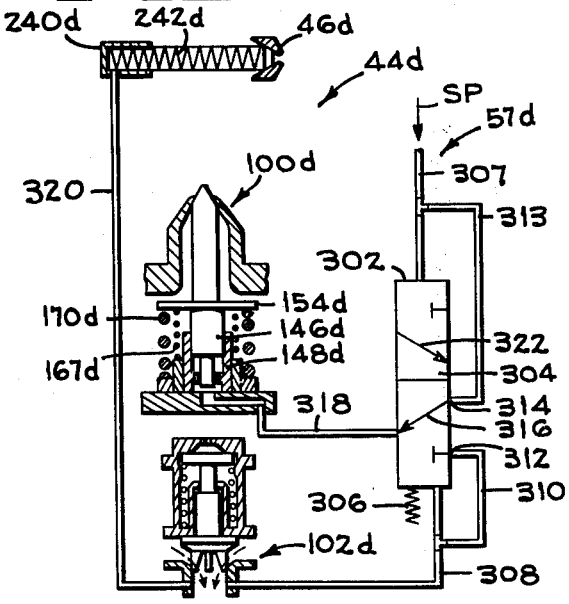
FIG. 12 is a schematic diagram illustrating a fifth hydraulic control system that is self-activating and modulating for use with the eductor nozzles of FIGS. 3 and 7 when associated with a single mining nozzle.

In FIG. 12 a hydraulic control system 57d is illustrated for modulating the eductor nozzle 100 during mining without requiring special control lines to the surface. Although the control system 57d will be described in relation to the previously described components of the first embodiment of the invention, it will be understood that such control system may also be used with the fourth embodiment of the invention if desired.

Since the mining nozzle 46, eductor nozzle 100 and foot valve 102 are the same as described in the first embodiment of the invention, only the modulating control system 57d will be described in detail, and parts of the system 57d that are equivalent to the system 57 will be assigned the same numerals folowed by the letter "*d*".

The control system 57d comprises a pilot actuated proportioning valve 302 having a core 304 therein which is held in the illustrated position by a preloaded spring 306 when system pressure is below the drilling pressure of between about 300–400 psig. When in the illustrated drilling position, system pressure SP in the tool string 36 (FIGS. 1 and 2) acts through a conduit 307 on the upper end of the core 304 tending to move it downwardly. This force is counteracted by the force of the spring 306 plus the pressure below the foot valve 102d, which pressure is substantially system pressure and is communicated to the other end of the proportioning valve 302 by a conduit 308. a branch conduit 310 connects the pressure conduit 308 to a port 312 in the valve which at this time is closed by the core 304. Similarly, the system pressure conduit 307, which is connected to the water supply at a point above the foot valve is connected by a branch conduit 313 to a port 314 in the valve and a passage 316 through the core 304. The passage 316 is connected to the eductor nozzle cylinder 148d by a conduit 318 while the mining nozzle cylinder 240 is connected below the foot valve by a conduit 320. Thus, when the system pressure is approximately drilling pressure, that pressure is also communicated into cylinders 148d and 240d thus holding both the eductor nozzle 100d and the mining nozzle 46d closed. The self-activating foot valve 102d will be open during drilling as previously described.

As system pressure is increased to full mining pressur of, for example, about 1000 psig, the foot valve 102d is closed as previously described resulting in cavity pressure below the foot valve. The 1000 psig system pressure also enters the conduit 307 and shifts the core 304 to the other end of its stroke at which time a passage 322 in the core communicates with port 312 and conduit 318 thus venting the eductor nozzle cylinder 148d to the very low cavity pressure. The mining nozzle 240d is likewise vented to cavity through conduit 320. The high system pressure acting on the eductor nozzle and the mining nozzle then overcomes the cavity pressure plus the pressure applied by springs 167d, 170d and 242d to fully open the eductor nozzle 100d and the mining nozzle 46d.

Modulation of the eductor nozzle 100d is accomplished by selecting and preloading the proportioning valve spring 306 so that it will cause the valve to shift through its entire modulating range in response to a system pressure variation of about 50 psig.

For example, if the modulating range of the nozzle is 40 percent, i.e., 60 percent open to fully open as previously described, and if 1000 psig is the maximum mining system pressure, variations of system pressure between 950 and 1000 psig will cause the eductor nozzle 100d to modulate through its entire 40 percent range. In accordance with the above example, it will be apparent that when the system pressure is 950 psig, the proportioning valve 302 will be partially opened and the swivel plate 154d will be contacting the heavy spring 170d. If the system pressure is increased to 975 psig for example, the heavy spring 170d is compressed unit the force developed by system pressure acting downwardly on the upper surface of the piston 146d is equal to the sum of the forces of the springs 167d, 170d and the force developed by the control pressure within the cylinder 148d, which cylinder pressure is controlled by the valve 302 to lie between system pressure and cavity pressure. Thus, each pressure setting between 950 and 1000 psig will cause the eductor nozzle 100d to open different amounts. The system pressure received from pump P (FIG. 1) may be varied by adjusting a valve 82 in the water inlet conduit 84, or by varying the speed of the pump P.

It will be understood that shifting the proportioning pilot valve 302 by varying the system pressure through the 50 psig modulating range will cause the proportioned pressure entering the eductor nozzle cylinder 148d to vary between about 150–500 psig.

DUAL MINING NOZZLE CONTROL SYSTEM WITHOUT SURFACE CONTROLS

A hydraulic control system 57e is diagrammatically illustrated in FIG. 13 and is designed for use with a mining and drilling apparatus having two mining nozzles 46e and 46". The control system 57e is self-activating, includes no control lines to the surface, and is capable of both modulating the eductor nozzle 100a and also selectively opening and closing the mining nozzles 46e and 46" in response to selective variations in the system pressure.

The eductor modulating portion 57de of the control system 57e is structurally the same, and is operated is the same way, as the modulating control system 57d illustrated in FIG. 1 except for the points at which the nozzle 46e and 46" are connected into the system 57e of the control system 57e will not be described in detail and parts of the system 57de which are equivalent to those of the system 57d will be assigned the same numerals followed by the letter "e".

The control system 57e includes conduits 332, 334 communicating with system pressure SP at a point in the outer water supply conduit 52 (FIG. 2). Conduits 336, 338, 240 and 308e are connected to vents V or the pressure existing at a point below the foot valve 102e, which pressure is substantially system pressure when the foot valve is open and is cavity pressure when the foot valve is closed.

After the drilling operation has been completed and the apparatus 30 (FIG. 1) is assembled in its mining mode, the pump P is started and directs water through the valve 82 and conduit 84 into the outer annular passage defined between the outer conduit 52 and inner conduit 50 of the tool string 36. As the water pressure within the conduit 52 reaches the mining system pressure of, for example, about 450 psig and is flowing at a rate of about 1700 gallons per minute, the foot valve **102*e* (FIG. 12) closes and the eductor nozzle 100*d* fully opens as previously described in regard to the control system 57*d* (FIG. 12). During this time the system pressure SP enters conduits 332 and 334 causing proportioning valve core 304*e* to move downwardly against the urging of spring 306*e* thereby venting eductor nozzle cylinder 148*e* to cavity through passages 318*e*, 322*e*, 310*e* and 308*e***.

System pressure SP is also directed upwardly through a conduit 342, a parallel passage 344 in the core 346 of a shuttle valve 348 and through conduit 350 into the cylinder 240″ of the upper mining nozzle 46″ thereby holding the upper mining nozzle closed. At this time the cylinder **240*e* of the lower mining nozzle 46*e* is vented to cavity through a conduit 352, parallel passage 354 in core 346, conduit 356 and the conduit 308*e*** to the well cavity.

The high pressure liquid which enters conduit 332 at system pressure SP initially flows through a passage 358 in the core 360 and of a valve 362. The high pressure liguid then flows through a conduit 364, a parallel passage 366 in the core 368 of a valve 370, and through a conduit 372 into one end of a valve 374 having a core 376 therein. The core 376 is connected to the core 346 of valve 348 by a link 378. High pressure liquid entering the end of the valve 374 then shifts the cores 346 and 376 from the illustrated positions to the left. Shifting the core 346 from its parallel passage position to its cross passage position closes lower mining nozzle **46*e* by directing high pressure liquid into the cylinder 240*e* through cross passage 380; and opens the upper mining nozzle 46″ by venting cylinder 240″ to cavity pressure through a cross passage 382**.

Shifting the core 376 to the left performs no function until the core 360 of valve 362 is fully shifted to the left. In this regard, high pressure liquid entering conduit 332 flows through conduit 384 into the right end of the valve 362 thus slowly shifting the core 360 to the left against the urging of a spring 386. The conduit 336 which vents the other end of the valve 362 to cavity pressure includes a flow resisting valve 388 through which the water in the left end of the valve 362 must flow before the core 360 can shift fully to the left. The flow resisting valve 388 is adjusted to slow the rate of movement of the core 360 sufficiently to permit all of the above described functions to occur before the core shifts.

After the core 360 shifts to the left, high pressure liquid flows through a passage 390 in the core 360, a conduit 392, parallel passage 394 in shifted core 376, and conduit 396 to the right end of the valve 370 thus shifting its core 368 to the left. The liquid in the other end of the valve 370 is vented to the well cavity through conduit 398, parallel passage 400 in the core 376 and conduit 340. Shifting of the valve core 368 has no immediate effect on the mining nozzle 46″ and **46*e*, but presets the control system 57*e* to shift the mining nozzle upon reducing the system pressure below the force pressure of the spring 386**.

As mentioned previously in regard to the modulating control circuit **57*d* illustrated in FIG. 12, modulation of the eductor nozzle is preferably accomplished by varying the system pressure within the range of between about 950 to 1000 psig. The pressure of spring 386 which controls valve 362 is preferably set to balance a system pressure of about 900 psig thus permitting full modulation of the eductor nozzle 100*e* without effecting the valve 362**.

When it is desired to open mining nozzle 46″ and close mining nozzle **46*e*, the system pressure is reduced to slightly below 900 psig by throttling valve 82 (FIG. 1). The spring 386 (FIG. 13) thus returns the valve core 360 to its illustrated right hand position and system pressure is thereafter increased to the desired mining pressure by opening control valve 82 (FIG. 1). High pressure fluid then flows through conduit 332 (FIG. 13), passage 358 in the valve core 360, conduit 364, a cross passage 404 in the core 368, and a conduit 406 to the left end of the valve 374 which returns both cores 376 and 346 to their illustrated positions. Shifting the core 376 to the right causes low pressure liquid to be vented from the right end of the valve 374 through the conduit 372, cross passage 410 and conduit 338 to the well cavity. Shifting the core 346 to the illustrated position opens mining nozzle 46*e* and closes mining nozzles 46″ as previously described. As the pressure from lines 332 and 384 again shift the core 360 to the left, high pressure liquid flows from conduit 332 through passage 390, conduit 392, cross passage 414 in the core 376, and conduit 398 thus shifting valve core 368 to its illustrated right hand position. At this time liquid in the right end of the valve 370 is vented through conduit 396, a cross passage 416 and the conduit 340** to cavity.

Thus, the above procedure is repeated each time the system pressure is dropped below 900 psig and thereafter returned to mining pressure. During mining, the eductor nozzle **100*e*** may be modulated as desired, without affecting the mining nozzles.

When system pressure is reduced to 0, the foot valve **102*e* is opened by the spring 232*e*, the eductor nozzle 100*e* is closed by springs 167*e* and 170*e*, and both mining nozzles 46*e* and 46″ are closed by springs 242*e* and 242″**.

Although the control system **57*e* has been described in conjunction with a modulating eductor nozzle, it will be understood that the upper portion of the system 57*e* may be used independently of the modulating system 57*de*. If used in this way, the conduit 342 would communicate with system pressure and the conduit 356 would communicate with cavity. In such a system, any of the herein described eductor nozzles and foot valves could be used, and the eductor nozzle could be controlled by a self-activated system similar to FIG. 8, or by a system having a control line to the surface such as control line 54 (FIG. 5**).

From the foregoing description it will be apparent that the drilling and mining apparatus of the present invention includes several modified forms of eductor pump sections wherein the foot valve is self-activating in response to the rate of flow of liquid therethrough. The foot valve is operated independently of the eductor nozzle and includes a dash pot which reduces the rate of closure of the foot valve to minimize "water hammer" which "water hammer" is further minimized by allowing the eductor nozzle to at least partially open prior to full closing of the foot valve. Several hydraulically operated control systems are included in the invention and permit modulation of the eductor nozzle when either one or two mining nozzles are being used without effecting the position of the mining nozzle or nozzles during modulation. When two mining nozzles are being used, the control system is effective to open only one mining nozzle at a time. The several hydraulic control systems may either include separate control lines to the surface, or may be self-energizing and be devoid of control lines to the surface. In all control systems, the pressure involved are equal to or less than mining system pressure which is between about 700–1000 psig in the illustrated preferred embodiments. Also, each control system is capable of adjusting the several operative components of the drilling and mining apparatus between the drilling mode and mining mode without withdrawing the tool string from the well cavity. In all configurations control pressure assists in holding the eductor and mining nozzles closed during drilling.

Although the best mode contemplated for carrying out the present invention has been herein shown and described, it will be apparent that modification and variation may be made without departing from what is regarded to be the subject matter of the invention.

I claim:

1. In a drilling and mining apparatus for slurry mining of granular ore from a deep well cavity, the combination comprising: a tool string in said well cavity; flow inducing means for directing a liquid into said tool string at variable system pressures and capacities which vary between relatively low drilling conditions and relatively high mining conditions; a mining nozzle included in and extending transversely of said tool string and including a mining nozzle cylinder and resilient means tending to maintain the mining nozzle in a closed position; an eductor pump section in said tool string including an eductor nozzle provided with an eductor nozzle cylinder and resilient means tending to maintain said eductor nozzle closed; and a foot valve in said eductor pump section operable independently of said eductor nozzle and including resilient means tending to hold said foot valve open; first hydraulic control means cooperating with said foot valve resilient means for maintaining said foot valve open in response to said system pressure and capacity being at drilling conditions, and for closing the foot valve in response to said system pressure and capacity being between drilling conditions and mining conditions; and second hydraulic control means for moving said mining nozzle and said eductor nozzle between closed and open positions.

2. An apparatus according to claim 1 wherein said drilling conditions include a drilling system pressure of about 300 psig and a capacity of about 1400 gallons per minute; and wherein said change over system pressure is between about 450 psig and a capacity of about 1700 gallons per minute flowing past the foot valve.

3. An apparatus according to claim 1 wherein means are included in said second control means and cooperates with said resilient means for said eductor nozzle for modulating said eductor nozzle through a predetermined modulation range in response to controlled variations of control pressure within said second control means acting upon said eductor nozzle.

4. An apparatus according to claim 3 wherein said modulating range of said eductor nozzle is between about 60 percent open and full open.

5. An apparatus according to claim 3 wherein said second control means is effective to modulate said eductor nozzle and to selectively open or close said mining nozzle independently of each other.

6. An apparatus according to claim 1 wherein said second control means includes at least one control conduit to the surface with surface controlled valve means therein.

7. An apparatus according to claim 1 wherein said second control means is devoid of control conduits to the surface and is self-activating in response to controlled variations in the system pressure within said tool string.

8. An apparatus according to claim 1 and additionally comprising a second mining nozzle, said second control means including means for selectively opening and closing each mining nozzle independently of the other.

9. An apparatus according to claim 8 wherein said second control means includes means for modulating said eductor nozzle through a predetermined modulating range in response to controlled variations of control pressure or system pressure acting on said eductor nozzle.

10. An apparatus according to claim 3 wherein said eductor nozzle includes a nozzle seat; a nozzle plug movable toward and away from said seat; said resilient means for said eductor nozzle including a weak spring disposed in engagement with said nozzle means at all times, and a stronger spring spaced from said seat until after said eductor nozzle has partially opened, further opening of said eductor nozzle plug means being within said modulating range and being effective to deflect both springs.

11. An apparatus according to claim 1 wherein said second control means is self-energizing, said second control means including a pilot actuated proportional valve having a shiftable core therein, a first end of said core communicating with said system pressure and the other end of said core communicating with cavity pressure when said foot valve is closed, and core activating resilient means normally holding said core against said first end and in position causing system pressure to be applied to said mining nozzle cylinder and said eductor nozzle cylinder to maintain said nozzles closed when said system pressure is low, increase of system pressure to full mining pressure being effective to overcome the force of said core activating resilient means thereby shifting said core and directing cavity pressure into said mining nozzle and eductor nozzle cylinders thereby fully opening the mining nozzle and the eductor nozzle.

12. An apparatus according to claim 11 wherein reduction of said system pressure within a predetermined modulating range from the maximum mining system pressure causes said eductor nozzle to modulate without effecting said mining nozzle.

13. An apparatus according to claim 12 wherein a system pressure of about 450 psig and a rate of flow of about 1700 gallons per minute is effective to close said foot valve; a system pressure of about 100 psig less than maximum mining system pressure is sufficient to start shifting the core against the urging of said core spring thereby starting to open said eductor nozzle, and wherein system pressure between maximum mining pressure and about 50 psig less than maximum mining pressure causes the core of said proportional valve to proportionally shift from its full cavity venting position causing said eductor nozzle to modulate.

14. An apparatus according to claim 12 and additionally including a second mining nozzle having a second mining nozzle cylinder, second mining nozzle resilient means tending to maintain the second mining nozzle closed, said second control means additionally including a first control conduit means connecting said first end of said core to system pressure, a second conduit means connecting the other end of said core to cavity pressure when the foot valve is closed, shuttle valve means in said first and second control conduit means movable between two operative positions upon sequential activation to alternately connect said first mining nozzle cylinder and said second mining nozzle cylinder to said first conduit means and to said second conduit means for opening one mining nozzle at a time, said second control means also including valve means responsive to changes between system pressure and cavity pressure induced by controlled variation of system pressure by said flow inducing means to thereby alternately open one and then the other mining nozzle.

15. An apparatus according to claim 14 wherein a system pressure of about 300 psig and above a rate of flow of about 1400 gallons per minute is insufficient to close said foot valve; a system pressure of about 100 psig less than maximum mining system pressure is sufficient to shift the core against the urging of said core spring and to activate said shuttle valve by shifting it to one of its two operative positions thereby start opening said eductor nozzle and fully open one of said mining nozzles, and wherein system pressure between maximum mining pressure and about 50 psig less than maximum mining pressure causes the core of said proportional valve to proportionally shift from its full cavity venting position causing said eductor nozzle to modulate.

16. An apparatus according to claim 1 and additionally including a second mining nozzle having a second mining nozzle cylinder, second mining nozzle resilient means tending to maintain the second mining nozzle closed, said second control means additionally including shuttle valve means movable between two operative positions upon sequential activation to alternately connect said first mining nozzle cylinder and said second mining nozzle cylinder to system pressure and to cavity pressure for opening one mining nozzle at a time, said second control means also including valve means responsive to controlled variation of system pressure by said flow inducing means to shift said shuttle valve means thereby alternately opening one and then the other mining nozzle.

17. An apparatus according to claim 16 wherein a system pressure of about 300 psig and about a rate of flow of about 1400 gallons per minute is insufficient to close said foot valve; and wherein a system pressure of about 100 psig less than maximum mining system pressure is sufficient to activate said shuttle valve by shifting it to one of its two operative positions.

18. A foot valve positioned between a first pressure zone subjected to variable system pressure and flow rates and a second pressure zone which pressure varies from slightly less than system pressure to cavity pressure, depending upon the flow rate and position of the foot valve cavity pressures therein comprising; an apertured valve seat for establishing fluid communication between said zones, a valve plug movable between an open position permitting flow of liquid through said valve seat and a closed position at least substantially terminating flow through said valve seat, a dash pot disposed in the first zone and associated with said plug to reduce the rate of closure of said plug; said dash pot including a housing communicating with said first pressure zone through bleed passage defining means for allowing liquid to enter said housing, a piston rod slidably received in said housing, a piston connected to said piston rod and disposed within said housing, resilient means disposed between a portion of said housing and said piston for urging said foot valve plug toward its open position, and means defining a bleed passage extending from one side of said piston to the other.

19. A foot valve according to claim 18 wherein said piston has a cylindrical periphery and is progressively aligned with a relatively large diameter cylindrical surface, a frusto-conical cylindrical surface, and a small diameter cylindrical surface of said housing as said foot valve plug is progressively moved toward its closed position, the space between said piston and said surfaces defining said bleed passage.

20. A foot valve according to claim 18 wherein said resilient means resists closing of said foot valve when the flow rate across said valve is less than about 1400 gallons per minute and is under a pressure less than about 300 psig, and closes due to an increased pressure drop across said valve when the flow rate is increased to about 1700 gallons per minute at about 450 psig.

21. A foot valve according to claim 18 and additionally comprising a bleed passage through said foot valve plug to provide a low capacity flow of liquid into said second pressure zone when the foot valve is closed.

22. A foot valve according to claim 19 and additionally comprising means defining a bleed hole through said piston.

23. A foot valve according to claim 18 wherein said piston rod is connected to said valve plug and moves therewith.

24. A foot valve according to claim 18 wherein said housing is rigid with said foot valve plug and moves with said plug relative to said piston during opening and closing of said foot valve.

25. A foot valve and eductor nozzle unit of a pipe string comprising: an apertured seat of a foot valve, means defining a system pressure zone in the pipe string on one side of the seat and a cavity pressure zone on the other side of the valve seat when the foot valve is closed; a foot valve plug, means defining a dash pot in said system pressure zone connected to said plug for controlling the rate of closing of said foot valve plug, and resilient means normally holding said foot valve plug open; eductor nozzle means including an apertured eductor nozzle seat, means defining an eductor nozzle plug-piston unit, an eductor nozzle cylinder slidably receiving said plug-piston unit, and eductor nozzle resilient means urging said piston-plug unit toward its closed position.

26. An apparatus according to claim 25 and additionally including flow inducing means for directing a liquid into the pipe string at system pressures which vary between relatively low drilling pressure and capacity conditions and relatively high mining pressure and capacity conditions; said foot valve being closed against the urging of said foot valve resilient means in response to said liquid being at mining conditions, and said eductor nozzle means being opened against the urging of said eductor nozzle resilient means in response to at least partial venting of said eductor nozzle cylinder.

27. An apparatus according to claim 25 wherein said eductor nozzle resilient means comprises a first relatively weak spring urging said nozzle toward the closed position at all times, and a strong modulating spring which contacts said plug-piston unit only after said eductor nozzle has been partially opened.

28. An apparatus according to claim 25 wherein said plug-piston unit includes shiftable connecting means between the plug and the piston of said unit to compensate for misalignment of said nozzle seat with said nozzle plug.

29. An apparatus according to claim 25 and additionally comprising control means for varying the pressure within said eductor nozzle cylinder between mining system pressure and cavity pressure for modulating said eductor nozzle.

30. An apparatus according to claim 27 and additionally comprising control means for varying the pressure within said eductor nozzle cylinder between mining system pressure and cavity pressure for modulating said eductor nozzle.

31. A close coupled foot valve and eductor nozzle unit of a pipe strint comprising: an apertured foot valve seat defining a system pressure zone on one side and a cavity pressure zone on the other side thereof when said valve seat is closed; means defining a dash pot having a housing communicating with said system pressure zone, a centrally apertured foot valve plug on the lower end of said housing for substantially sealing said foot valve aperture when closed and resilient means normally urging said foot valve plug to its open position; means defining an eductor nozzle having a nozzle seat, a nozzle plug-piston unit, a nozzle cylinder means including a cylindrical bore for receiving said plug-piston unit and including a cylinder base having a transverse bore therein, and resilient means urging said plug-piston unit towards its nozzle closing position; and tubular conduit means concentric with and connected to said cylinder means and slidably receiving said dash pot housing, said tubular conduit means establishing flow communication between said cavity and one of said bores in said nozzle cylinder means when said valve is closed.

32. An apparatus according to claim 31 and additionally comprising a piston connected to said tubular conduit means and disposed within said housing, and means defining a bleed passage extending from one side of said piston to the other.

33. An apparatus according to claim 32 wherein said passage gradually decreases in size as the plug moves toward the closed position thereby controlling the rate of closure of the foot valve plug.

34. An apparatus according to claim 31 wherein said tubular conduit means communicates with said cylinder bore.

35. An apparatus according to claim 31 wherein said tubular conduit means communicates with said transverse bore therein said cylindrical bore being blocked from communication with said tubular conduit.

36. An apparatus according to claim 31 and additionally comprising a mining nozzle in said pipe string; said mining nozzle including an apertured mining nozzle seat, a mining nozzle cylinder, a mining nozzle plug movable between an open position and a closed position and having its external surfaces subjected to system pressure, resilient means urging said mining nozzle plug to its closed position, and conduit means including one of said bores connecting said mining nozzle cylinder to said tubular conduit means.

37. An apparatus according to claim 34 and additionally comprising a mining nozzle in said pipe string; said mining nozzle including an apertured mining nozzle seat, a mining nozzle cylinder, a mining nozzle plug movable between an open position and a closed position and having its external surfaces subjected to system pressure, resilient means urging said mining nozzle plug to its closed position, and conduit means including said cylinderical bore connecting said mining nozzle cylinder to said tubular conduit means.

38. An apparatus according to claim 35 and additionally comprising a mining nozzle in said pipe string; said mining nozzle including an apertured mining nozzle seat, a mining nozzle cylinder, a mining nozzle plug movable between an open position and a closed position and having its external surfaces subjected to system pressure, resilient means urging said mining nozzle plug to its closed position, and conduit means including said transverse bore connecting said mining nozzle cylinder to said tubular conduit means.

39. A close coupled foot valve and eductor nozzle unit of a pipe string comprising an apertured foot valve seat, means defining a system pressure zone in the pipe string subjected to variable system pressures and flow rates on one side of said seat, means defining a cavity pressure zone in the pipe string on the other side of said seat subject to pressure varying from slightly less than system pressure to cavity pressure depending upon flow rate and the position of the foot valve, a centrally apertured foot valve plug movable between an open position permitting flow of liquid through said valve seat and a closed position at least substantially terminating flow through said valve seat, a dash pot disposed in the system pressure zone and associated with said plug to reduce the rate of closure of said plug; said dash pot including a housing rigid with said valve plug and communicating with said system pressure zone through bleed passage defining means for allowing liquid to enter said housing, a tubular piston rod slidably received in said housing, a piston connected to said piston rod and disposed within said housing, resilient means disposed between a portion of said housing and said piston for urging said foot valve plug toward its open position, means defining a bleed passage extending from one side of said piston to the other which passage gradually decreased in size as the plug moves toward the closed position thereby maintaining a controlled closing rate in the face of increasing pressure drag across the foot valve; an eductor nozzle seat secured to the pipe string, an eductor nozzle cylinder rigidly secured to said seat, an eductor nozzle plug slidable in said eductor cylinder between open and closed positions, and resilient means disposed between said eductor nozzle cylinder and said eductor nozzle plug for urging said piston toward said closed position, said tubular piston rod establishing communication between said eductor nozzle cylinder and said cavity pressure zone when said foot valve is closed, a predetermined pressure drop across said foot valve being effective to close said foot valve thus creating a pressure differential between system pressure and cavity pressure that is sufficiently high to cause system pressure acting on the external surfaces of the eductor nozzle plug to open the eductor nozzle.

40. An apparatus according to claim 39 and additionally comprising a mining nozzle in said pipe string; said mining nozzle including an apertured mining nozzle seat, a mining nozzle cylinder, a mining nozzle plug movable between an open position and a closed position and having its external surfaces subjected to system pressure, resilient means urging said mining nozzle plug to its closed position, and conduit means connecting said mining nozzle cylinder to said eductor nozzle cylinder, said predetermined pressure drop creating a pressure differential acting on said mining nozzle plug sufficient to open said mining nozzle when said foot valve is closed.

41. An apparatus according to claim 39 wherein said foot valve resilient means precludes closing of said foot valve when the flow rate across said valve is less than about 1400 gallons per minute at a pressure less than about 300 psig, and closes in response to an increased pressure drop across said valve when the flow rate is increased to about 1700 gallons per minute at about 450 psig.

42. An apparatus according to claim 39 wherein said piston rod is coaxial with said pipe string permitting the cavity pressure zone of the pipe string to be threaded onto the system pressure zone of said pipe string.

* * * * *

UNITED STATES PATENT OFFICE

CERTIFICATE OF CORRECTION

Patent No. 4,059,166 Dated November 22, 1977

Inventor(s) PHILIP R. BUNNELLE

It is certified that error appears in the above-identified patent and that said Letters Patent are hereby corrected as shown below:

| | |
|---|---|
| Column 4, line 55 | Change "48" to "58." |
| Column 8, line 17 | Change "nozle" to "nozzle" and "45" to "46." |
| Column 8, line 22 | Change "pressue" to "pressure." |
| Column 9, line 6 | Change "vavle" to "valve." |
| Column 9, line 22 | Change "than" to "that." |
| Column 7, line 13 | Change "operated" to "operates." |
| Column 8, line 15 | Change "249" to "240." |
| Column 14, line 15 | Change "gy' to "by." |
| Column 14, line 56 | Change "secion" to "selection." |
| Column 15, line 29 | Change "folowed" to "followed." |

UNITED STATES PATENT OFFICE

CERTIFICATE OF CORRECTION

Patent No. 4,059,166 Dated November 22, 1977

Inventor(s) PHILIP R. BUNNELLE

It is certified that error appears in the above-identified patent and that said Letters Patent are hereby corrected as shown below:

| | |
|---|---|
| Column 16, line 22 | Change "unit" to "until." |
| Column 16, line 48 | Change "100a" to "100e." |
| Column 16, line 55 | Change "Fig. 1" to "Fig. 11." |
| Column 17, line 10 | Change "100d" to "100e." |

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*